United States Patent [19]

Berlec

[11] 4,208,609

[45] Jun. 17, 1980

[54] SQUIRM RESISTANT FILAMENT

[75] Inventor: Ivan Berlec, South Euclid, Ohio

[73] Assignee: General Electric Company, Schenectady, N.Y.

[21] Appl. No.: 945,793

[22] Filed: Sep. 25, 1978

[51] Int. Cl.[2] ..... H01K 1/42; H01K 9/08

[52] U.S. Cl. ..... 313/315; 313/341; 313/344

[58] Field of Search ..... 313/315, 341, 344

[56] References Cited

U.S. PATENT DOCUMENTS

| | | | |
|---|---|---|---|
| 3,462,631 | 8/1969 | Hashimoto et al. | 313/344 X |
| 3,522,466 | 8/1970 | Kamegaya et al. | 313/344 X |

*Primary Examiner*—Saxfield Chatmon, Jr.

*Attorney, Agent, or Firm*—Lawrence R. Kempton

[57] ABSTRACT

Low wattage incandescent lamp filaments have improved squirm resistance when wound with low mandrel ratios and high pitch ratios. Squirm resistant is further enhanced when the filament is mounted under tension.

4 Claims, 4 Drawing Figures

SQUIRM RESISTANT FILAMENT

This invention relates to low wattage lamps having incandescent filaments, eg. 25 watts or less, and, in particular, to miniature and subminiature lamps.

A type of filament distortion known as squirm can be a serious problem in some incandescent lamp types, particularly low wattage lamps using fine wire, eg. this problem is a cause of poor lamp performance and premature failure of the filament. More specifically, when these filaments are heated for the first time, they curl. Subsequent operation generally increases the curling. Occasionally the filament may curl on itself, shorting out a segment, or curl around a support wire, causing hot and cold spots, all of which shorten the life of the filament and deteriorate the performance of the lamp.

This curling is believed to result from the coil winding process, which both bends and twists the wire. The resulting stresses are currently partially relieved by annealing the wire on the molybdenum mandrels on which the coil was wound. The annealing process reduces squirm by reducing the strain energy stored in the filament by the coiling process. As a result, the axial tension, under which the filament must be held to prevent curling, is reduced.

The annealing may lead to other problems, such as bulb blackening due to molybdenum contamination and/or filament embrittlement due to partial recrystallization. The annealing can take one of two forms: the filament is "flashed", ie. raised to a high temperature by passing current through it, or it is indirectly heated to a high temperature, eg. 1800°–2000° C. At these elevated temperatures, the contamination and/or embrittlement can occur.

It has been found that another way to reduce the tension under which the filament must be held is to increase the bending stiffness of the coil. This is accomplished by controlling the winding parameters of the coil, viz. the coil is wound with low mandrel ratios and high pitch ratios.

In view of the foregoing, it is therefore an object of the present invention to eliminate or substantially reduce filament squirm in low power lamps.

A further object of the present invention is to reduce filament squirm in low power lamps without annealing the filament at elevated temperatures.

Another object of the presnt invention is to provide improved miniature and sub-miniature lamps having more uniform light output over the life of the lamp.

A further object of the present invention is to provide improved miniature and subminiature lamps less subject to premature filament failure due to squirm.

The foregoing objects are achieved in the present invention wherein low wattage filaments are wound, contrary to current practice, with low mandrel ratios and high pitch ratios. In the lamp mount, the filament is held in tension, even when lighted. For coiled coil filaments, a low mandrel ratio is used for the second winding.

A more complete understanding of the present invention can be obtained by considering the following detailed description in conjunction with the accompanying drawings in which.

Figure 1:
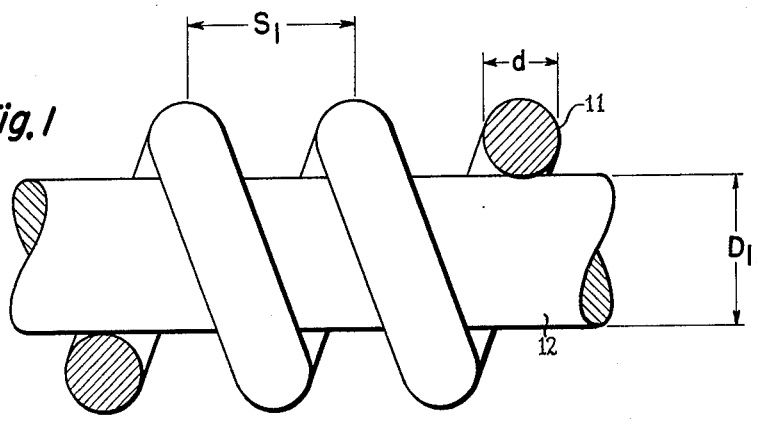
FIGS. 1, 2 and 3 illustrate different coiling parameters.
Figure 2:
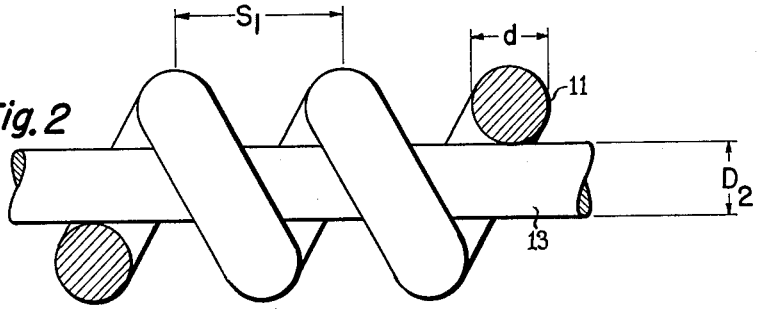
Figure 3:
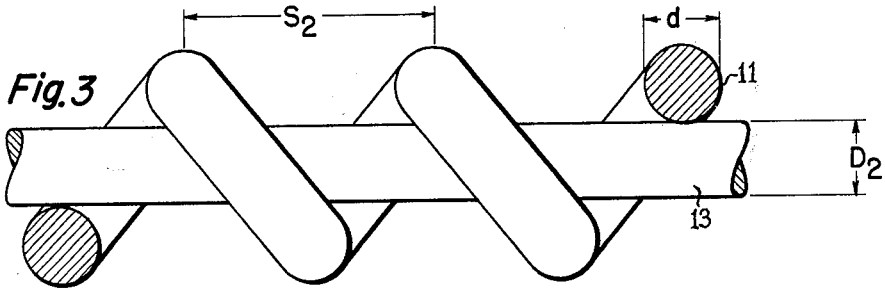

FIGS. 1–3 illustrate various coiling parameters for a filament wound on a mandrel. Specifically, in FIG. 1, filament 11, which typically comprises tungsten, is wound about a mandrel 12, which may, for example, comprise molybdenum. Coiling parameters include pitch and mandrel ratios. The pitch ratio, or percent pitch, is equal to S, the center to center spacing of the turns, divided by d, the diameter of the filament, times 100. The mandrel ratio, or percent mandrel, is equal to D, the diameter of the mandrel, divided by d, times 100.

In FIG. 2, the diameter of mandrel 13 is smaller than the diameter of mandrel 12. Thus, comparing the filaments of FIGS. 1 and 2, the filaments have the same pitch ratio but the filament of FIG. 2 has a smaller mandrel ratio than the filament of FIG. 1. In FIG. 3, the center to center spacing of the coils of the filament has been increased, as compared to FIG. 2, while the size of the mandrel remains the same. Thus, compared to FIG. 2, the filament illustrated in FIG. 3 has a higher pitch ratio but the same mandrel ratio. In FIG. 3, the filament has a higher pitch ratio and a lower mandrel ratio than the filament illustrated in FIG. 1. In accordance with the present invention filaments having higher pitch ratios and lower mandrel ratios than those customarily used in the prior art are used to reduce filament squirm in low-power filaments.

In the prior art, single coil filaments typically, and without regard to combination, have a mandrel ratio in the range of 300–700% and a pitch ratio in the range 140–180%. In accordance with the present invention a single coil filament has a mandrel ratio of less than 300% and a pitch ratio in excess of 160%, preferably in excess of 180%. As can be seen by inspection of FIG. 3, filaments in accordance with the present invention are longer than those of the prior art, assuming the same wattage, life, and efficacy, due to the particular combination of pitch and mandrel ratios. This may present a problem for lamps with envelopes having a small volume, eg. miniature and subminiature lamps, ie. lamps having an envelope diameter of 6 mm, (0.25 inch) or less.

This problem is overcome by using a coiled coil filament in miniature and smaller lamps. Coiled coils are not per se new. Coiled coil filaments typically, and without regard to combination, have a mandrel ratio in the range 180–200% and a pitch ratio in the range 140–180%, for both coilings.

For coiled coil filaments in accordance with the present invention the mandrel ratio of the first coiling is preferably in excess of 250% while the mandrel ratio for the second coiling is preferably below 150%, combined with a pitch ratio for the second coiling in excess of 160%. As understood by those of skill in the art, d for the second coiling is the outside diameter of the first coil. Also understood, the particular mandrel and pitch ratios used in following the present invention depends in part on the thermomechanical history of the tungsten wire used for the filament. Similarly, those of skill in the art understand that mandrel ratios less than 120% are generally undesirable and that pitch ratios in excess of approximately 200% may lead to excessive entanglements of the filaments as they are stored in batches awaiting loading into the mount machine.

Figure 4:
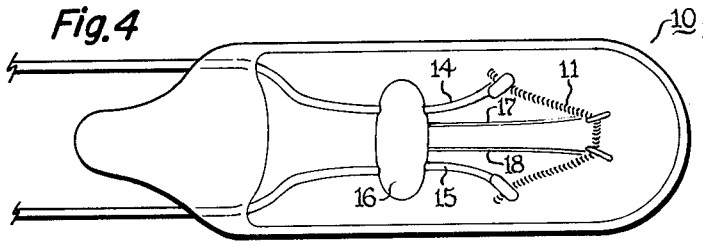
FIG. 4 illustrates a lamp in accordance with the present invention.

FIG. 4 illustrates a lamp in accordance with the present invention comprising what is known in the art as a C-2F mount, ie. the filament is suspended between two lead wires and two support wires. Specifically, filament 11, which may comprise a single coil or a coiled coil filament, is mounted under tension between lead wires 14 and 15 and attached thereto by suitable clamps or welds. Lead wires 14 and 15 are held in place by bead 16 into which support wires 17 and 18 are also embedded. Filament 11 is held between lead wires 14 and 15 and across supports 17 and 18 in slight tension, even when the lamp is lighted. The combination of the axial tension and coiling parameters in accordance with the present invention serves to substantially reduce or eliminate filament squirm in low power lamps, eg. lamps comprising a filament having a diameter of 25 microns (1 mil) or less.

Having thus described the invention it will be apparent to those of skill in the art that various modifications can be made within the spirit and scope of the present invention. For example, various filament configurations can be utilized, supported or unsupported, so long as the requirement is met that the filament be under at least some tension even when lighted.

What I claim as new and desire to secure by United States Letters Patent is:

1. An incandescent lamp having reduced filament squirm comprising a coiled coil refractory metal filament characterized by second coiling mandrel ratio below 150%, a second coiling pitch ratio greater than 160%, and a power dissipation of less than 25 watts; and a pair of lead wires attached one to each end of said filament, said filament being mounted under axial tension between said lead wires.

2. The incandescent lamp as set forth in claim 1 wherein said filament is characterized by a first coiling mandrel ratio in excess of 250% and a first coiling pitch ratio in excess of 180%.

3. The incandescent lamp as set forth in claim 1 wherein said filament is supported.

4. The incandescent lamp as set forth in claim 1 wherein said filament is unsupported.

* * * * *